US005611159A

United States Patent [19]

Jensen

[11] Patent Number: 5,611,159

[45] Date of Patent: Mar. 18, 1997

[54] METHOD AND APPARATUS FOR FEEDING LAUNDRY ARTICLES TO A LAUNDRY PROCESSING APPARATUS

[75] Inventor: Jørn M. Jensen, Bern, Switzerland

[73] Assignee: Ejnar Jensen & Søn A/S, Rønne, Denmark

[21] Appl. No.: 432,424

[22] Filed: Apr. 27, 1995

[30] Foreign Application Priority Data

Apr. 28, 1994 [DK] Denmark ..... 0492/94

[51] Int. Cl.[6] ..... D06F 67/04; B65G 47/22

[52] U.S. Cl. ..... 38/143

[58] Field of Search ..... 38/143; 271/222, 271/233, 261; 198/728, 733, 734, 729; 162/270, 271

[56] References Cited

U.S. PATENT DOCUMENTS

| | | | |
|---|---|---|---|
| 3,431,665 | 3/1969 | Weir | 38/143 |
| 3,464,131 | 9/1969 | McCabe | 38/143 |
| 3,772,808 | 11/1973 | Behn | 38/143 |
| 3,911,604 | 10/1975 | Sjostrom | 38/143 |
| 5,416,992 | 5/1995 | Ueda et al. | 38/143 |

FOREIGN PATENT DOCUMENTS

| | | |
|---|---|---|
| 0266820A2 | 5/1988 | European Pat. Off. . |
| 0419382A1 | 3/1991 | European Pat. Off. . |
| 0424290A1 | 4/1991 | European Pat. Off. . |

*Primary Examiner*—Ismael Izaguirre

*Attorney, Agent, or Firm*—Finnegan, Henderson, Farabow, Garrett & Dunner

[57] ABSTRACT

A method and an apparatus for feeding substantially rectangular laundry articles to a laundry processing apparatus, such as an ironing roller, comprising alignment of the laundry article to a predetermined angle with respect to the direction of feed of the laundry article on a conveyor face on which the laundry article is conveyed with the rear edge stretched, seen with respect to the direction of feed, as well as lateral displacement of the laundry article on the conveyor face to a desired position transversely to the direction of feed, said lateral displacement being performed after the laundry article has been aligned. This provides a more precise positioning of the laundry article.

9 Claims, 7 Drawing Sheets

METHOD AND APPARATUS FOR FEEDING LAUNDRY ARTICLES TO A LAUNDRY PROCESSING APPARATUS

BACKGROUND OF THE INVENTION

The present invention concerns a method of feeding substantially rectangular laundry articles to a laundry processing apparatus, such as an ironing roller, comprising alignment of the laundry article to a predetermined angle with respect to the direction of feed of the laundry article on a conveyor face on which the laundry article is conveyed with the rear edge stretched, seen with respect to the direction of feed, as well as lateral displacement of the laundry article on the conveyor face to a desired position transversely to the direction of feed. The invention also concerns an apparatus for performing the method.

These apparatuses are primarily used in big laundries in which they are used for smoothing and spreading large laundry articles, such as sheets, table-cloths, slips for eider-downs, etc. for subsequent insertion of the laundry article into e.g. an ironing roller, it being important that these feeding devices spread and smooth the laundry articles effectively so that undesired creases will not occur after the ironing roller. Most frequently, the laundry articles are inserted into the apparatus by a laundry article being taken from a pile of laundry articles in a wrinkled state and optionally wet or damp, following which the laundry article is inserted into the machine, which subsequently processes the laundry article so that it can be transferred to e.g. an ironing roller in a spread and smoothened state.

Even though the laundry article is thus transferred to an optional ironing roller in a spread and smoothened state, unintentional creases in the laundry article may occur, however, after the ironing roller, if the laundry article is inserted askew into the ironing roller. These unintentional creases are produced in that, in this case, the ironing roller first pulls a corner of the laundry article forwardly, thereby forming creases on the laundry article. It is therefore important e.g. in connection with such ironing rollers that the laundry article is oriented such that the entire one edge of the laundry article is moved into the ironing roller approximately in parallel with the axis of rotation of the ironing roller.

Therefore, feeders are frequently provided with a device capable of orienting the laundry article such that when inserted into a subsequent optional ironing roller the laundry article has the desired orientation.

Numerous proposals for the construction of devices capable of performing the above-mentioned processes are known today. Thus, EP Patent Application 266 820 discloses a feeder comprising a roller capable of rotating about its own axis, the laundry article being so positioned across said roller as to extend down on both sides of the roller. The laundry article will then frequently be disposed askew on the roller, which is therefore adapted so as to be twistable about its longitudinal axis such that the laundry article may be aligned with respect to the roller. This alignment takes place by positioning the laundry article with respect to a plurality of optical sensors arranged in a horizontal plane with respect to each other so that these can detect an edge on the part of the laundry article which hangs down on one side of the roller. The roller can then be rotated and twisted in sequence, so that the edge of the laundry article precisely covers the row of optical sensors, said laundry article having thereby been aligned with respect to the feed direction of the roller.

Further, EP Patent Application 424 290 discloses a feeder having a short and wide conveyor belt across which the laundry article is hung so as to hang down on each side of the conveyor belt. Sensors are provided here too, detecting the position of the rear edge of the laundry article on the conveyor belt with a view to aligning the laundry article with respect to this conveyor belt. In this device, the alignment takes place by retaining the part of the laundry article hanging down on one side, while causing the laundry article to be moved with respect to the conveyor belt. This is effected by pressing an elongate rod toward the laundry article between the location where the laundry article is retained and the conveyor belt, whereby the laundry article is displaced on the conveyor belt, thereby making it possible to align the laundry article with respect to the conveyor belt.

In certain situations, e.g. when a folding-up machine capable of automatically folding-up the laundry articles is mounted after the ironing roller, it is moreover important that the laundry articles are positioned precisely in a lateral direction with respect to the direction of feed of the laundry article prior to optional folding-up so that the folding-up will be neat and uniform. For this purpose, there are folding-up machines which can displace the laundry article transversely prior to the folding-up. However, these folding-up machines require that the laundry article is displaced transversely before the folding-up is begun, which reduces the production rate of these machines. It is therefore desirable that such transverse displacement can be performed already in the feeder.

In both of the above-mentioned known devices the laundry article is inserted in that the laundry article is pulled from the side across the roller or the conveyor belt by a gripper, thereby enabling initial positioning of the laundry articles on the roller or the conveyor belt. However, the subsequent alignment of the laundry article on the roller or the conveyor belt may cause the initial positioning to be destroyed.

Accordingly, the object of the present invention is to provide a method of feeding and a machine for performing this method, by means of which the lateral positioning may be performed precisely in a simple manner.

SUMMARY OF THE INVENTION

This object is achieved by providing a method of feeding substantially rectangular laundry articles to a laundry processing apparatus, such as an ironing roller, comprising alignment of the laundry article to a predetermined angle with respect to the direction of feed of the laundry article on a conveyor face on which the laundry article is conveyed with the rear edge stretched with respect to the direction of feed, and lateral displacement of the laundry article on the conveyor face to a desired position transversely to the direction of feed, characterized in that the lateral displacement is performed after the laundry article has been aligned.

Also provided is an apparatus for feeding substantially rectangular laundry articles to a laundry processing apparatus, such as an ironing roller, comprising a conveyor face on which the laundry articles are fed so that the rear edge of the laundry article, seen in the direction of feed, is stretched in any angle with respect to the direction of feed, and means for aligning the rear edge to a predetermined angle with respect to the direction of feed as well as means for laterally displacing the laundry article on the conveyor face to a desired position transversely to the direction of feed, characterized in that the means for transverse displacement of the laundry article are adapted to displace the laundry article laterally after the laundry article has been aligned.

Since the lateral positioning of the laundry article according to the invention is performed after the alignment of the laundry article with respect to the direction of feed, it is ensured that this positioning is not destroyed subsequently in the feeder. In addition, it is simple to position the laundry article since the laundry article has already been aligned in the feeder.

BRIEF DESCRIPTION OF THE DRAWINGS

An expedient embodiment of the invention will be described more fully below with reference to the drawing, in which.

DETAILED DESCRIPTION OF THE INVENTION

Figure 1:
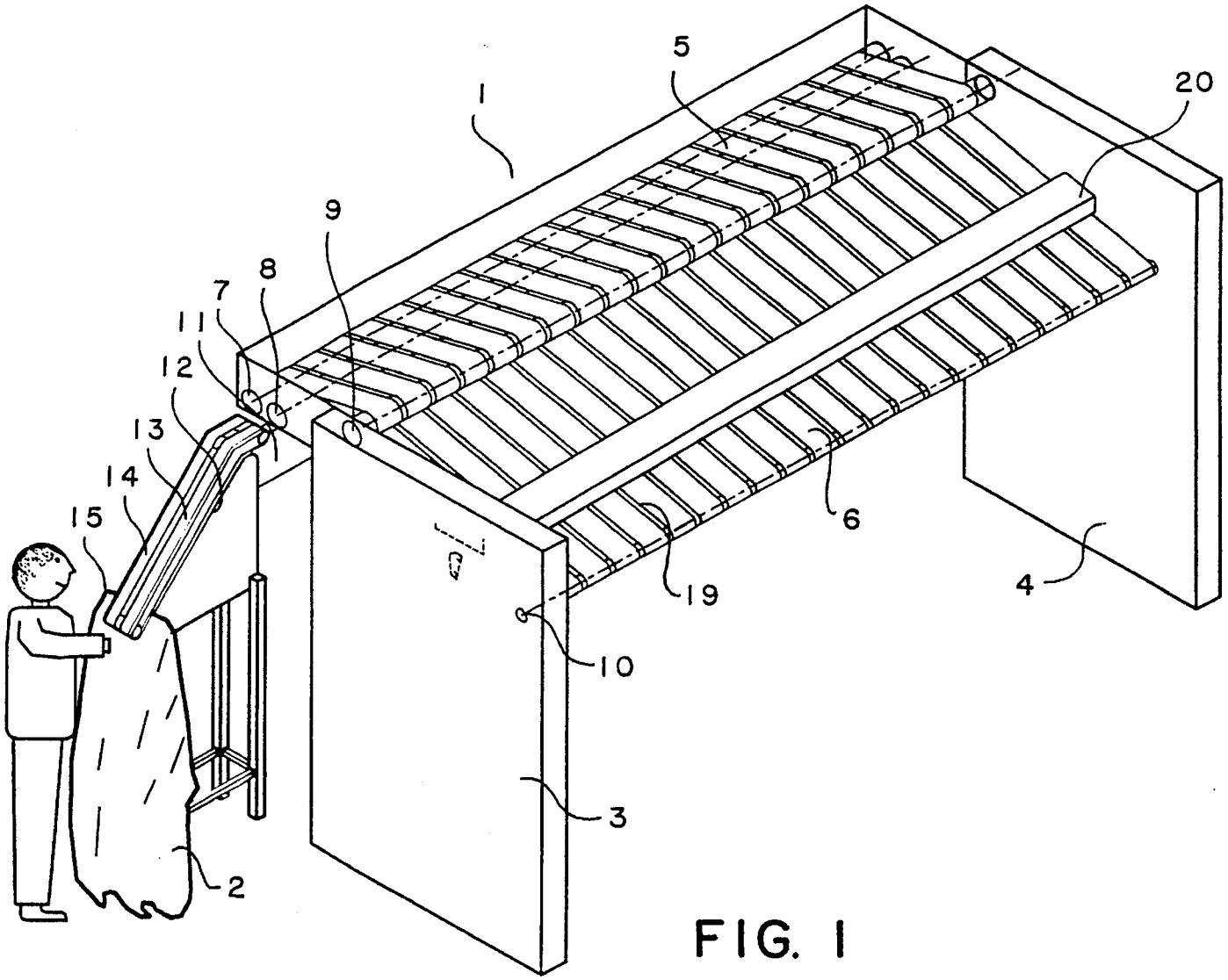
FIG. 1 is a perspective view of an apparatus according to the invention and of an operator.

FIG. 1 is a schematic and perspective view of an embodiment of a feeder apparatus according to the invention. The apparatus 1 is provided with two end gables 3 and 4 between which two conveyor belts 5 and 6 are located. The conveyor belt 6 extends partly below the conveyor belt 5, and the conveyor belt 6 is tightened by the rollers 8 and 10. A bar 11 whose function will be described more fully below, is located below and straight in front of the rollers 7 and 8.

Figure 6:
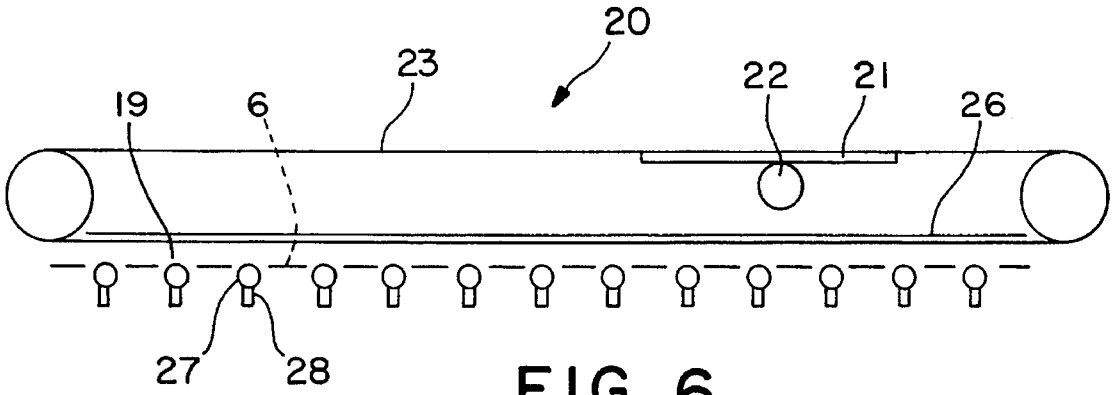
FIG. 6 is a schematic view of the mode of operation of the invention in an expedient embodiment.

An operator-operated insertion device is positioned at one end of the bar 11, as shown; the insertion device here consists of an underlying runway 12, above which two parallel conveyor belts 13 and 14 are positioned so as to be in firm engagement with the runway 12. The conveyor belt 6 is formed by a row of ribbons which are arranged with mutual spaces 19, and a gripper device shown as a beam 20, which will be described more fully with reference to FIG. 6, is arranged across the conveyor belt 6.

The operator starts the process by inserting the laundry article 2 between the conveyor belts 13 and 14 and the underlying runway 12, so that one corner 15 of the laundry article is positioned laterally of the conveyor belts 13 and 14, and so that a small portion of the edge of the laundry article 2 is stretched between the conveyor belts 13 and 14 and the underlying runway 12. The conveyor belts 13 and 14 are then activated to pull the laundry article 2 up to the bar 11.

The function and mode of operation of the feeder 1 will be described now as a series of individual processes according to the method of the invention.

Figure 2A:
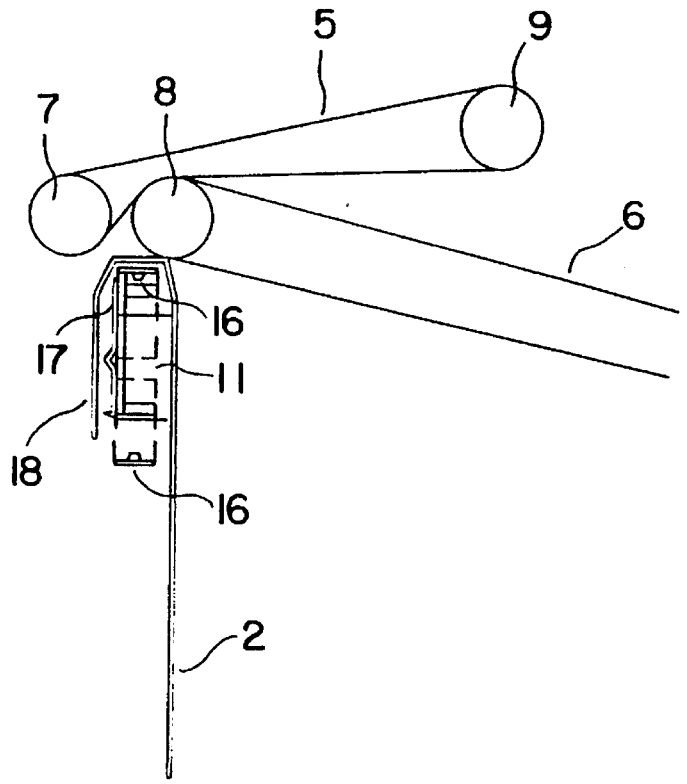
FIG. 2*a* is schematic sectional view of a detail in the apparatus of FIG. 1.
Figure 2B:
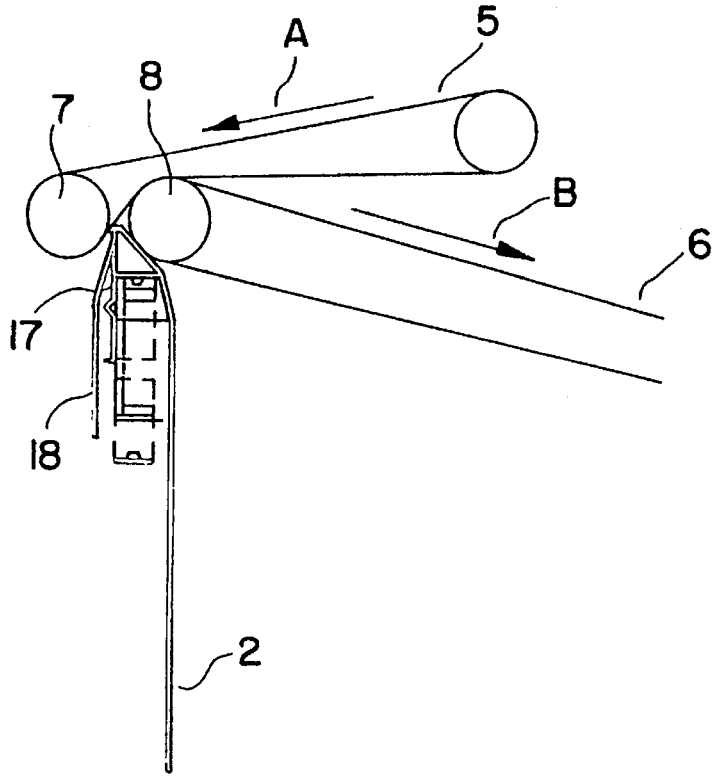
FIG. 2*b* is a view of the detail of FIG. 2*a* in another process position.

FIG. 2*a* thus shows that the laundry article 2 is pulled across the bar 11, which is positioned below the rollers 7 and 8 that tighten the conveyor belts 5 and 6. This is done through the provision of a narrow conveyor belt 16 which extends in the entire length of the bar, and which can thus pull the entire laundry article 2 into position on the bar 11. When the laundry article 2 is introduced at the end of the bar with one of the corners 15 of the laundry article 2, as stated above, the laundry article 2 hangs across the bar 11 with a minor flap 18 bent across the bar 11. The bar 11 additionally comprises a slidable plate element 17 which extends in the entire length of the bar 11. It is thus shown in FIG. 2*b* how the slidable plate element 17 is moved by means (not shown) up toward the rollers 7 and 8 with the conveyor belts 5 and 6, the conveyor belt 5 being caused to move in the direction of the arrow A, the conveyor belt 6 being correspondingly caused to move in the direction of the arrow B. The movements of the conveyor belts 5 and 6 will thus cause the laundry article 2 with the bent flap 18 to be pulled by the slidable plate element 17, which is moved up between the rollers 7 and 8.

Figure 3:
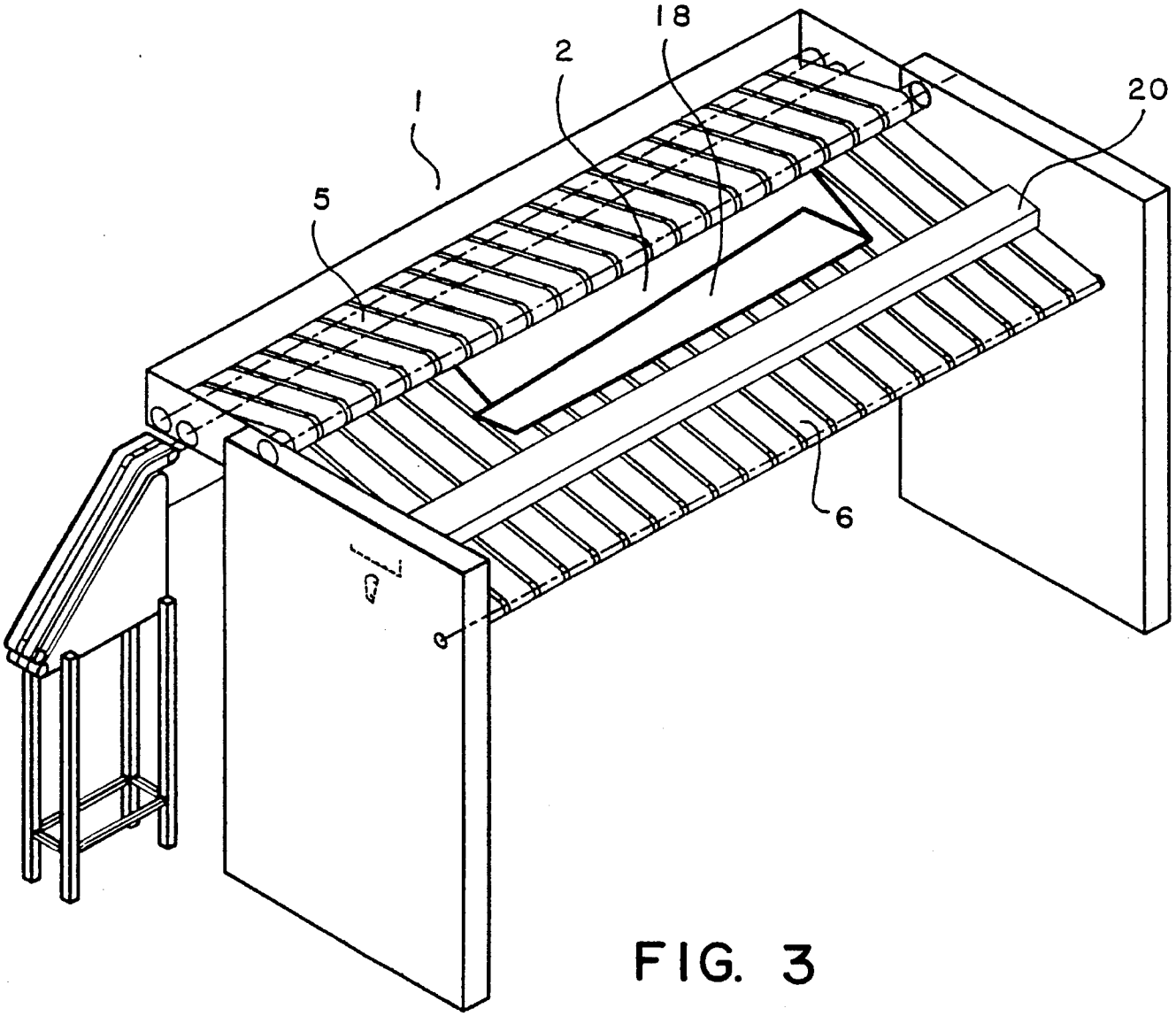
FIG. 3 is a view of the apparatus of FIG. 1 with a laundry article transferred in the machine with a crease.
Figure 4:
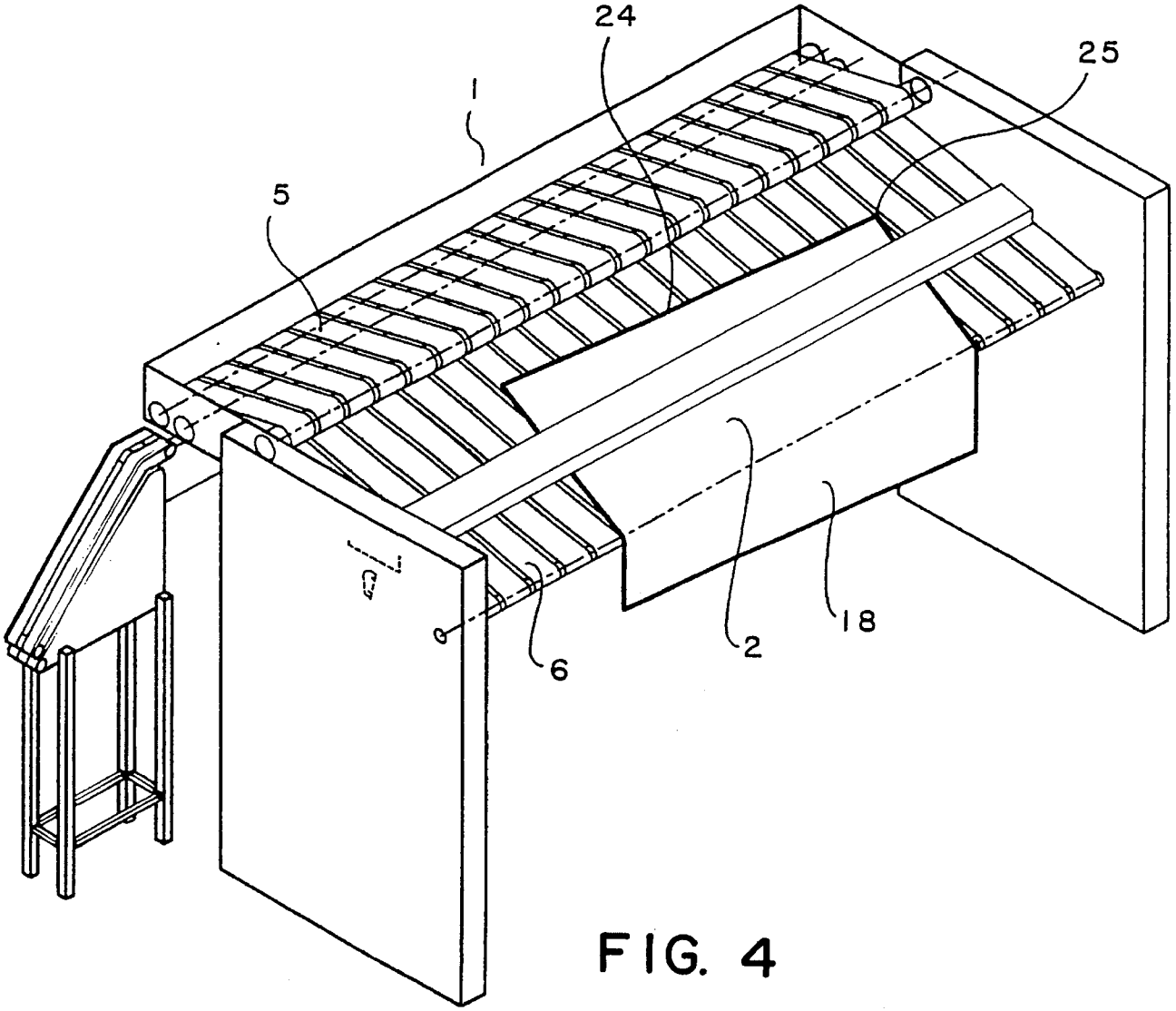
FIG. 4 shows the apparatus of FIG. 3 where the laundry article is smoothed out.

The movements of the conveyor belts 5 and 6 will then bring the laundry article 2 with the bent flap 18 into a position in which the laundry article 2 is positioned, as shown in FIG. 3, on top of the conveyor belt 6. Since the laundry article 2 has now been removed from the bar 11, the operator can insert a new laundry article 2 already now and begin the process once more. Final smoothing of the laundry article 2 then takes place, as shown in fig. 4, in that the continued movement of the conveyor belt 6 in the direction B shown in FIG. 2*b* causes the laundry article 2 to be moved toward the edge on the conveyor belt 6 which is defined by the roller 10, following which the bent flap 18 on the laundry article 2 drops beyond the edge, and the laundry article has hereby been completely straightened and smoothed.

The beam 20 of the gripper device, as shown in detail in FIG. 6 includes aligning means and lateral displacement means and comprises a transverse conveyor belt 23 which extends across the conveyor belt 6, said transverse conveyor belt 23 being provided with a rack 21 which can drive the transverse conveyor belt 23 transversely across the conveyor belt 6 by means of a gear wheel 22 located on the drive shaft of a suitable drive means such as an electric motor. The transverse conveyor belt 23 is supported by a support 26 at the face directed toward the underlying conveyor belts 6. A plurality of clamping faces or rollers 27 are provided in the spaces 19 between the conveyor belts 6 and are displaceable upwards from the position shown in the drawing to engage the transverse conveyor belts 23, said rollers 27 being capable of rolling on said transverse conveyor belt 23 during the movement thereof. Electric actuators 28 at each of the rollers 27 are used here for activating this up and down movement of the rollers 27.

Figure 5:
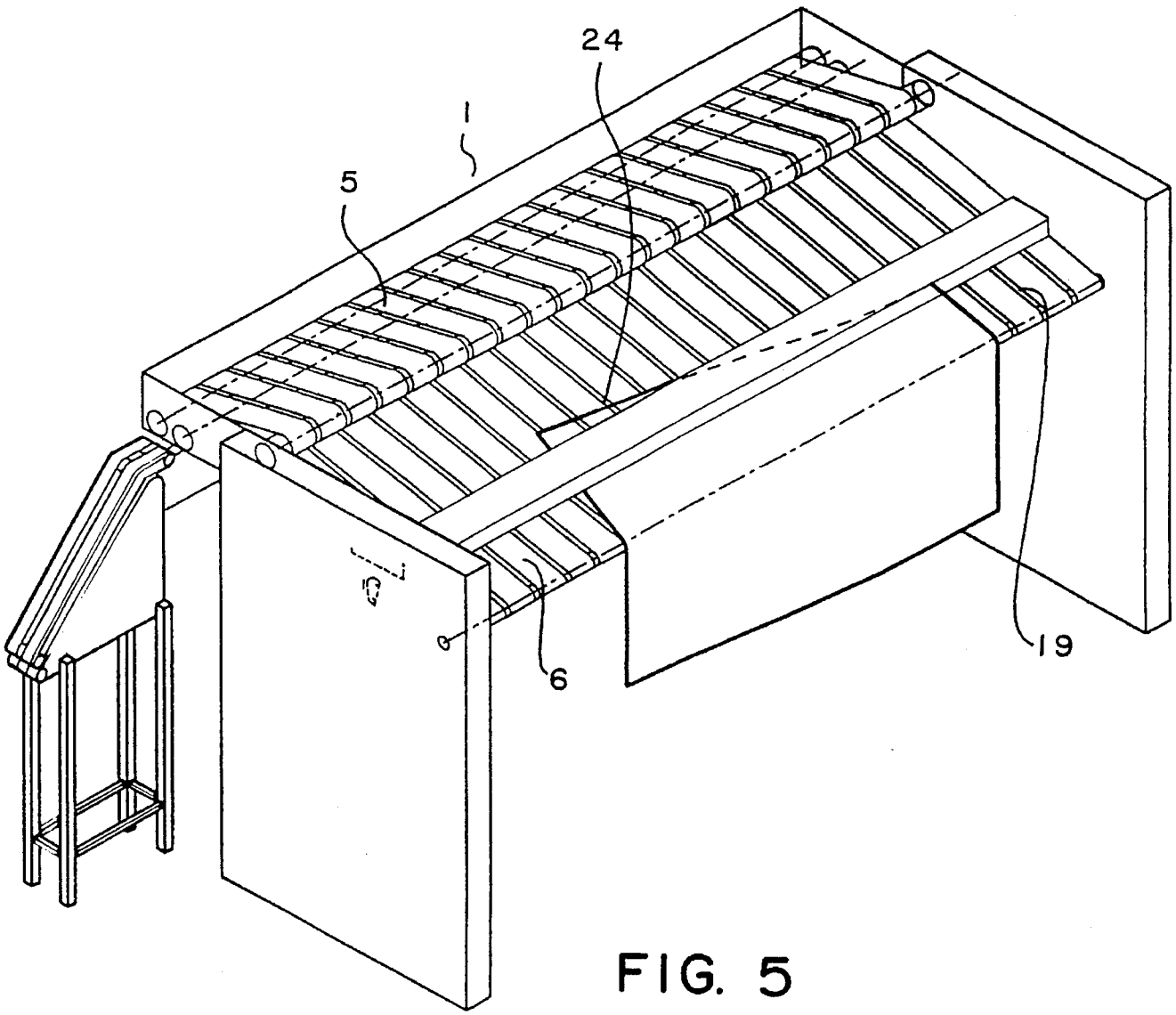
FIG. 5 shows the apparatus of FIG. 3 where the laundry article has been partly braked at its rear edge.
Figure 7:
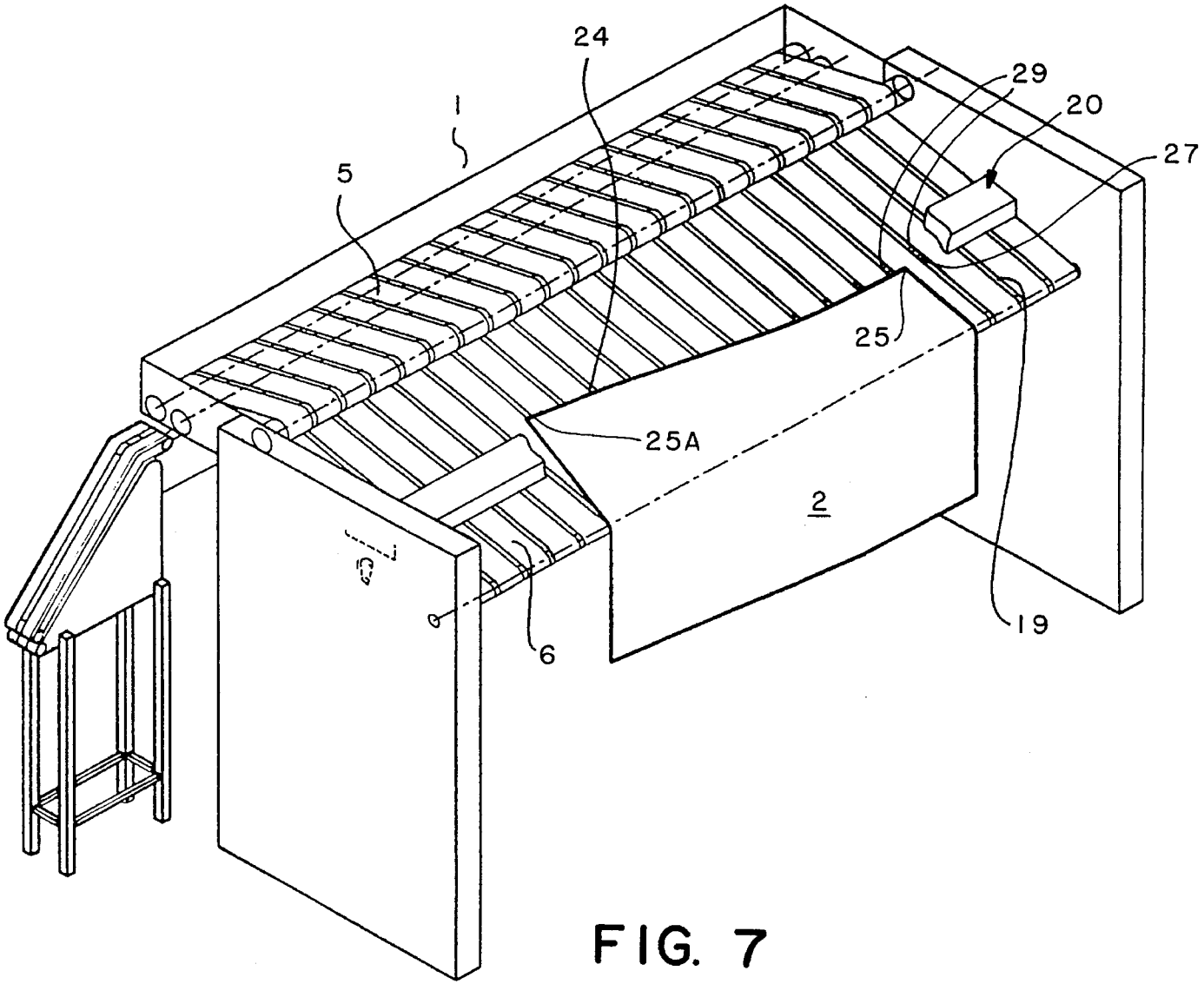
FIG. 7 is a view similar to FIG. 5 but with the beam broken away to reveal the senors and rollers.

Photocells or sensors 29 (see FIG. 7) of a detection device are located in front of the rollers 27, seen in the direction of feed of the conveyor belt 6, said photocells registering or detecting the position of the rear edge 24 of the laundry article 2 when it passes by, following which the rollers 27 are activated according to the invention by means of the electric actuators to engage the transverse conveyor belt 23 so that the rear edge of the laundry article 2 is grouped and retained against movement, the continued forward movement of the conveyor 6 thereby aligning the article, as shown in FIG. 5 shows how the rear edge 24 of the laundry article is braked locally from one corner 25 of the article towards the other corner 25A as the rollers 27 are sequentially activated by the actuators 28. After the entire laundry article 2 has been aligned, the electric motor provided for the gear wheel 22 is activated, following which the laundry article 2 may be displaced laterally.

Thus the laundry article is gripped solely at its edge and is transversely displaced solely by transverse displacement of the rear edge, which allows a particularly simple and thereby inexpensive structure.

Further, by performing the alignment and the transverse displacement with the same gripper device, this increases the efficiency of the feeder, since the laundry article does not have to be stopped more than once in the feeder to achieve both alignment and transverse displacement.

The laundry article 2 has hereby been aligned and laterally displaced in a simple manner with respect to the direction of feed B of the conveyor 6, following which the rollers 27 are retracted, and the laundry article 2 may be passed further on in the apparatus and optionally be transferred to a subsequent ironing roller. The shown embodiment of the invention is unique in being a particularly simple and inexpensive structure, while providing a high degree of operational reliability in the apparatus. Clearly, it will be evident to a skilled person to provide sequence controls and drive devices, etc. so that the feeder 1 can automatically perform the above-mentioned functions. Accordingly, such sequence controls and drive devices, etc. are not described in detail here.

I claim:

1. A method for feeding a substantially flat laundry article to a laundry processing apparatus comprising feeding the article along a substantially flat face of a conveyor in a feeding direction with a rear edge of the article stretched flat across the conveyor face and past a straight line extending at a predetermined angle with respect to the direction of feed, aligning the rear edge of the article with said straight line as the rear edge passes said line to align the article with respect to the feeding direction and thereafter laterally displacing the entire laundry article on the conveyor face in a direction transverse to the feeding direction after the laundry article has been aligned to position the article laterally on the conveyor face.

2. The method of claim 1, wherein the laundry article is aligned by gripping and retaining the rear edge of the article as it passes said straight line to thereby align the rear edge of the article with the line, the continued forward movement of the article, while the rear edge is being gripped, thereby straightening out and aligning the article, said article being thereafter laterally displaced by displacing the rear edge of the article laterally while it is being gripped.

3. The method of claim 2, including the step of detecting the position of the rear edge of the laundry article with respect to the conveyor face at a plurality of locations along its length in a direction transverse to the feeding direction and subsequently gripping and retaining the rear edge of the article in response to its detected position with a gripper device that grips and retains the rear edge at a plurality of locations along said straight line as the rear edge passes said line to thereby align the rear edge of the article with the line, and thereafter laterally displacing the rear edge of the laundry article on the conveyor face with the gripper device.

4. The method of claim 1, wherein the conveyor face has a width in the transverse direction and the article is laterally displaced so that it is centered with respect to said width of the conveyor face.

5. An apparatus for feeding substantially flat rectangular laundry articles to a laundry processing apparatus comprising a conveyor having a substantially flat conveyor face for conveying the articles in a feeding direction with the rear edge of the article stretched flat across the conveyor face, aligning means for aligning the rear edge of the article with a straight line extending at a predetermined angle with respect to the direction of feed to align the laundry article with respect to the feeding direction and lateral displacement means for laterally displacing the entire laundry article in a direction transverse to the feeding direction to a desired position on the conveyor face after the article has been aligned by the aligning means.

6. The apparatus of claim 5, wherein the aligning means and the lateral displacement means comprises a gripper device that grips and retains the rear edge of the article as the article passes the straight line to thereby align the edge with the line, the continued forward movement of the article, while the rear edge is being gripped, straightening out and aligning the article, said gripper device thereafter displacing the rear edge of the article laterally, while it is being gripped, to position the article laterally on the conveyor face.

7. The apparatus of claim 6, including a detection device adapted to detect the rear edge of the article with respect to the conveyor face at a plurality of locations along its length in a direction transverse to the direction of feed, said gripper device, in response to the detected position of the rear edge, locally braking the rear edge of the article as the rear edge passes said straight line to align the article and thereafter laterally displacing the article to said desired position.

8. The apparatus of claim 7, wherein the conveyor face comprises a plurality of parallel conveyor belts arranged side by side with mutual spaces between them and said gripper device comprises a transverse conveyor belt that extends transversely to and across the parallel conveyor belts at the straight line and a plurality of slidable clamping faces located between the parallel conveyor belts and opposite the transverse conveyor belt, said clamping faces being individually movable toward the transverse conveyor belt to grip the rear edge of the laundry article between said faces and transverse conveyor belt as the rear edge passes the straight line, and means for driving said transverse conveyor belt to laterally displace the gripped laundry article to said desired position.

9. The apparatus of claim 8, wherein the slidable clamping faces are rollers mounted on nine shafts extending substantially perpendicular to the direction of movement of the transverse conveyor belt.

* * * * *